US009221252B2

(12) United States Patent
Cofler

(10) Patent No.: US 9,221,252 B2
(45) Date of Patent: Dec. 29, 2015

(54) CONTROLLING INK DEPOSITION DURING PRINTING

(75) Inventor: Marian Cofler, Lod (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/877,415

(22) PCT Filed: Oct. 21, 2010

(86) PCT No.: PCT/US2010/053527

§ 371 (c)(1),
(2), (4) Date: Apr. 2, 2013

(87) PCT Pub. No.: WO2012/054037

PCT Pub. Date: Apr. 26, 2012

(65) Prior Publication Data

US 2013/0187968 A1 Jul. 25, 2013

(51) Int. Cl.

| | |
|---|---|
| ***B41J 29/38*** | (2006.01) |
| ***B41J 2/045*** | (2006.01) |
| ***B41J 2/21*** | (2006.01) |
| ***B41J 3/54*** | (2006.01) |
| ***B41J 11/00*** | (2006.01) |

(52) U.S. Cl.

CPC ..... *B41J 2/0457* (2013.01); *B41J 2/0458* (2013.01); *B41J 2/04501* (2013.01); *B41J 2/2128* (2013.01); *B41J 3/543* (2013.01); *B41J 11/002* (2013.01)

(58) Field of Classification Search

None

See application file for complete search history.

(56) References Cited

U.S. PATENT DOCUMENTS

| | | | | |
|---|---|---|---|---|
| 7,140,711 | B2 | 11/2006 | Nerad et al. | |
| 7,387,352 | B2 * | 6/2008 | Florence et al. | 347/9 |
| 2002/0122106 | A1 | 9/2002 | Ylitalo | |
| 2006/0023026 | A1 | 2/2006 | Hoshino | |
| 2007/0013757 | A1 * | 1/2007 | Ohnishi | 347/102 |
| 2009/0000508 | A1 | 1/2009 | Edison et al. | |
| 2009/0289981 | A1 | 11/2009 | Hasenbein et al. | |
| 2010/0002039 | A1 | 1/2010 | Kikuchi et al. | |
| 2010/0110132 | A1 | 5/2010 | Smith | |

FOREIGN PATENT DOCUMENTS

| | | | |
|---|---|---|---|
| EP | 1555131 | A2 | 7/2005 |
| JP | 2004291418 | A | 2/2006 |
| WO | WO2008059276 | | 5/2008 |

OTHER PUBLICATIONS

David B. Wallace, Wirang Shah, Donald J. Hayes, Michael E. Grove; Photo-Realistic Ink-Jet Printing Dynamic Spot Size Control; http://www.microfab.com/about/papers/ist95/ist95.html.

* cited by examiner

*Primary Examiner* — Geoffrey Mruk

(57) ABSTRACT

Systems and methods of controlling ink deposition during printing are disclosed. An example of a method includes actuating a plurality of print heads to deposit ink on a substrate. The method also includes activating an energy source to speed cure of the deposited ink on the substrate. The method also includes adjusting electrical output to the plurality of print heads to compensate for different distances from the energy source to each of the plurality of print heads.

15 Claims, 6 Drawing Sheets

CONTROLLING INK DEPOSITION DURING PRINTING

BACKGROUND

Color printers have become increasingly more commonplace with advances in printing technologies. High-quality, inexpensive color printers are readily commercially available in a wide variety of sizes ranging from portable and desktop inkjet printers for use at home or at the office, to large commercial-grade color printers.

Traditionally, printers were used primarily for printing text documents. Today, however, color printers are available and are routinely used to print complex images, such as digital photographs. The printed image is typically made from multiple passes of print heads which deposit ink onto a substrate. Good printing quality and ink-to-substrate adhesion are achieved when ink wets the substrate. Ink deposited on wettable substrates spreads and exhibits what is known as "positive dot gain." Various energy sources (e.g., ultra-violate (UV) radiation, blowers, heaters, etc.) may be used to help cure the ink faster and reduce the spread of ink (i.e., reduce "positive dot gain") to better control image quality.

The print heads are located at different distances from the energy source(s). When the print heads traverse a substrate in one direction, ink ejected by the print head located farther from the energy source spreads for a longer time before being cured by the energy source, than ink ejected by the print head located closer to the energy source. Accordingly, the ink which has had more time to spread before being cured, forms spots larger ink "dots" than the ink which had less time to spread before being cured, resulting in poor image quality.

DETAILED DESCRIPTION

Printing systems and methods for controlling ink deposition during printing are disclosed. An example of a printing system may include a plurality of print heads configured to deposit ink on a substrate. At least one energy source is configured to speed cure of the deposited ink on the substrate. A controller is operatively associated with the plurality of print heads. The controller is configured to adjust electrical output to the plurality of print heads to compensate for different distances from the at least one energy source to each of the plurality of print heads.

In an embodiment, the controller is configured to change the electrical output to the plurality of print heads based on direction the plurality of print heads is moving. The electrical output corresponds to volume of ink deposited by the plurality of print heads. For example, a smaller volume of ink is deposited by print heads located a greater distance from the energy source, and a larger volume of ink is deposited by print heads located a lesser distance from the energy source. Accordingly, the systems and methods disclosed herein may reduce undesirable effects of uneven positive dot gain, reducing or altogether eliminating undesirable artifacts in the printed image, and improving overall print quality.

Figure 1:
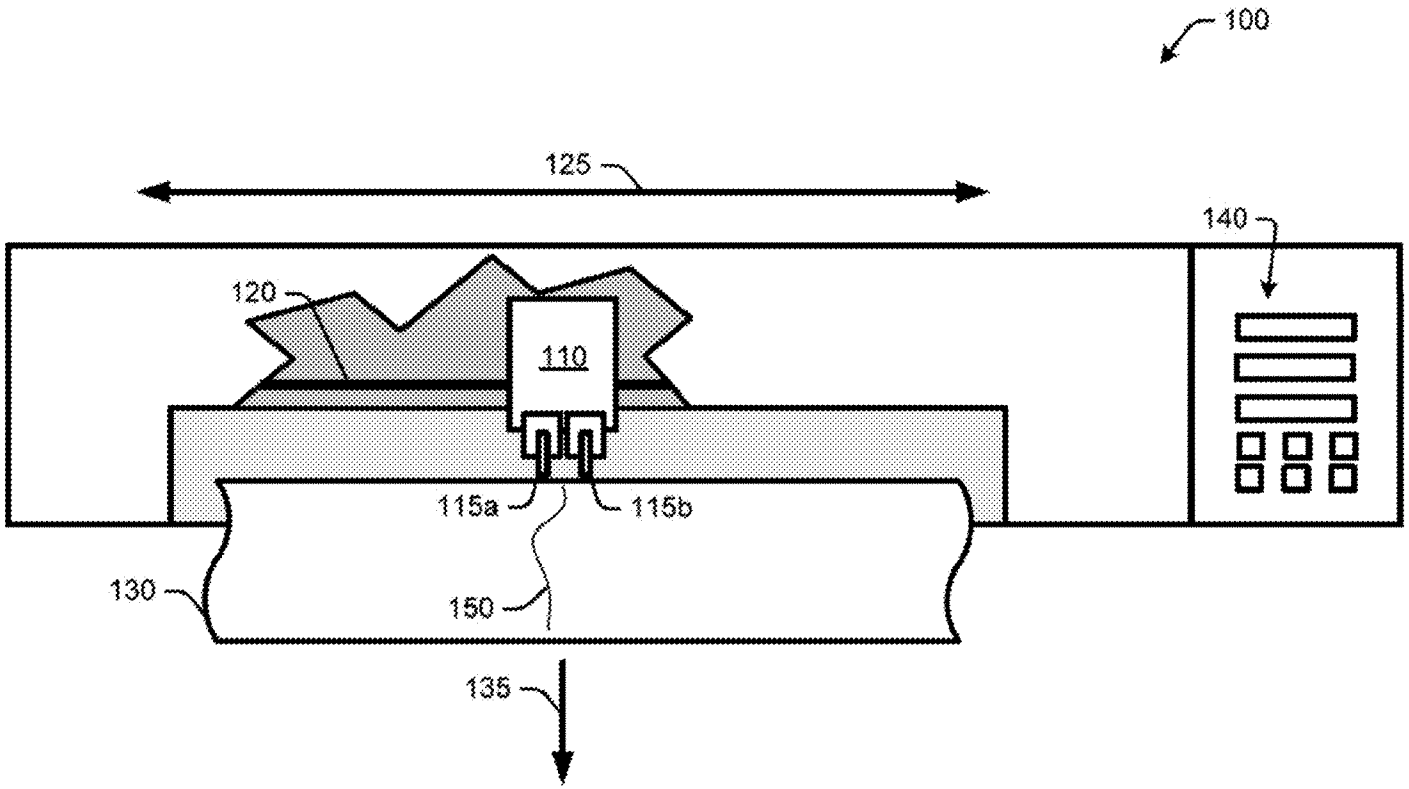
FIG. 1 is a high-level illustration of an exemplary printing system which may be implemented for controlling ink deposition during printing.

FIG. 1 is a high-level illustration of an exemplary printing system which may be implemented for controlling ink deposition during printing. Exemplary printing system or printer 100 may be an inkjet printer or other suitable printer now known or later developed which has been modified according to the teachings herein.

Printer 100 may include one or more print heads provided on a carriage 110 to move along rail 120 in at least two directions (e.g., the directions illustrated by arrow 125) as a substrate (e.g., paper 130) is fed through the printer (e.g., in the directions illustrated by arrow 135). Of course, print heads may move in any desired direction depending on the construction of the printer 100.

Print heads 115*a* and 115*b* are visible in FIG. 1 for purposes of illustration. Typically, at least four, and often more than four print heads, are used for printing color images. Printers printing with six and more colors are also commercially available. Each of the print heads (or a group of print heads) ejects a primary color such as Cyan, Magenta, Yellow, and Black (according to the CMYK color scheme), to form the colored image. The print heads may be mounted on the carriage reciprocating relative to the substrate or be static with substrate transported in two orthogonal directions (as shown in FIG. 1).

A controller may be provided to control operations. An example of a controller is illustrated diagrammatically as controller 550 in FIG. 5. Although not visible in FIG. 1, controller may reside on the carriage 110 or behind an external control panel 140. The specific placement of the controller is not important. The controller is implemented on a circuit board including various circuitry, such as, but not limited to, computer-readable storage and a processor configured to execute program code (e.g., firmware or software) configured to control various electronics and hardware associated with the printer 100. Optionally, the controller may be operatively associated with the external control panel 140 for input/output by a user. The controller may also be operatively associated with an external device (not shown), such as a computer or other electronic device (e.g., a mobile device) for input/output by the device.

The controller may be operatively associated with a driving mechanism (not shown) to move the carriage 110 along the rail 120 in the directions illustrated by arrow 125, and a feed mechanism (not shown) to move the paper adjacent the print heads on carriage 110 in the directions illustrated by arrow 135. The controller may also be operatively associated with one or more inkjet cartridges fluidically connected to the print heads to control the flow of ink through the print heads for transfer onto a substrate (e.g., as illustrated in FIG. 1 by line 150 on paper 130). In an exemplary embodiment, the controller delivers a voltage to the print heads to cause the print heads to eject a volume of ink. The amount and timing of ink being ejected can be controlled based on the voltage applied to the print head by the controller. Other suitable means for controlling the ejection of ink are also contemplated.

Before continuing, it is noted that the construction and operation of printing systems are well understood in the computer and printer arts, and can readily be modified by those having ordinary skill in the art to implement the functions described after becoming familiar with the teachings herein. Therefore further detailed description of the printer 100 itself is not necessary for a full understanding of the systems and methods described herein. It is also noted that the embodiments for controlling ink deposition during printing are not limited to any particular type or configuration of printer. For example, the systems and methods described herein may be used with printers in which the carriage moves the print heads relative to the substrate, printers in which the substrate moves relative to the print heads, and a combination thereof wherein both the print heads and the substrate move relative to one another.

In any event, a printer 100 includes a mechanism for transporting a substrate on which impression has to be made, and one or more print heads are located in a position relative to the substrate that enables depositing ink on the substrate. The print heads may be static or have a freedom of relative movement with respect to the substrate. The substrate may be a rigid or flexible substrate and the printer 100 may be adapted for printing images on various types of substrates.

Figure 2:
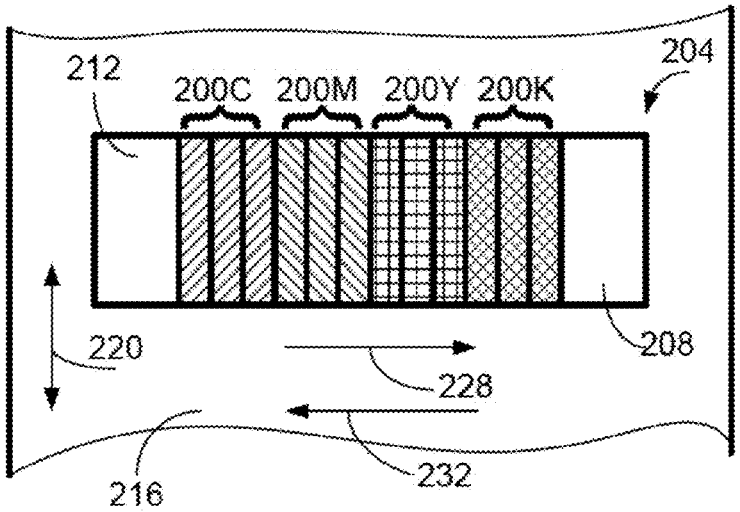
FIG. 2 shows an example of a print head configuration for a printer.

The inks may be curable using any of a wide variety of energy sources. One or more energy sources (e.g., UV radiation, blowers, heaters, etc.) may be used to help cure the ink faster and reduce the spread of ink (i.e., reduce "positive dot gain") to better control image quality. Although not visible in FIG. 1, an embodiment of energy sources 208 and 212 is shown in FIG. 2 as the energy sources may be positioned adjacent the print heads 200C, 200M, 200Y, and 200K on a carriage (e.g., carriage 110 in FIG. 1). The energy sources are typically mounted to the carriage on either side of the print heads and usually the trailing energy source (e.g., energy source 208 in FIG. 2 when the print head is moving in the direction of arrow 232) is operated to cure the deposited ink when the carriage travels in one direction (see arrow 232 in FIG. 2), while the other energy source (e.g., energy source 212 in FIG. 2) is inactivated. When the carriage changes direction (see arrow 228 in FIG. 2), the previously inactivated energy source (e.g., energy source 212 in FIG. 2) is activated and becomes the trailing energy source, while the other energy source (e.g., energy source 208 in FIG. 2) is inactivated. Configurations where both energy sources are operative at the same time are also contemplated. Likewise, configurations with only one or more than two energy sources are also contemplated. The number of print heads may also vary from one design to the next.

FIG. 2 shows an example of a print head configuration for a printer (e.g., inkjet printer 100 in FIG. 1). A number of drop-on-demand inkjet print heads include one or more Black (K) print heads 200K, one or more Yellow (Y) print heads 200Y, one or more Magenta (M) print heads 200M, and one or more Cyan (C) print heads 200C are mounted on a carriage 204. Energy sources 208 and 212 (e.g., UV radiation sources) are attached to and positioned on either side of the carriage 204, such that all print heads 200 are located between the energy sources, albeit at different distances between the print heads and the energy sources. This distance also changes based on which of the energy sources 208 or 212 are activated. That is, print head 200C is close to the energy source when energy source 212 is activated, but farthest away from the energy source when energy source 212 is inactive and energy source 208 is activated.

The carriage 204 is located opposite substrate 216 at a distance which facilitates ink deposition onto the substrate. During operation, the substrate 216 moves in any one of the directions indicated by arrow 220. The carriage 204 reciprocates relative to substrate 216 in a direction shown by arrows 228 and 232. Because the print heads 200 are located different distances from the energy sources 208 and 212 activated for cure the printed image, when the carriage 204 traverses across the substrate 216 in a first direction (e.g., in the direction indicated by arrow 228) while the energy source 212 is activated, ink from the black ink print head 200K tends to have more time to spread on the paper before being cured and therefore forms larger ink spots on the substrate. This is referred to as positive dot gain. Ink that is deposited by the other print heads, and in particular print head 200C has less time to spread on the paper before being cured and therefore forms smaller ink spots. For example, yellow ink from print head 200Y forms larger ink spots than the ink from the magenta and cyan print heads 200M and 200C when moving in the direction illustrated by arrow 228 and energy source 212 is activated and the print heads eject ink droplets of equal volume. A similar (but opposite) result is observed when the carriage 204 moves in the second or opposite direction 232 and energy source 208 is activated.

Figure 3:
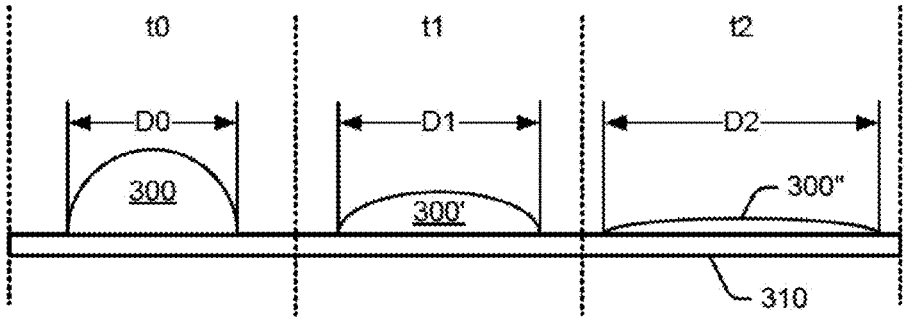
FIG. 3 is a cross-section side view illustrating an ink droplet on a substrate at different times.

FIG. 3 is a cross-section side view illustrating an ink droplet 300 on a substrate 310 at different times. The ink droplet 300 may be transferred onto the substrate 310 by the printing system using conventional printing techniques. At time t0, the ink droplet 300 has just been transferred to the substrate 310. At time t1, the ink droplet begins to wet to the substrate and spread. At time t2, the ink droplet is exposed to the energy source and cures. Between time t0 when the ink first hits the substrate, and time t2 when the ink is cured, the ink droplet 300 spreads out, as can be seen by the increasing diameters illustrated by D0, D1, and D2 of ink droplets 300, 300', and 300" corresponding to times t0, and t2, respectively in FIG. 3.

This spreading out of the ink droplet, or positive dot gain, depends on a variety of factors such as the ink properties, and typically occurs on the order of a fraction of a second to a few seconds. Ink properties that may affect spreading can include particle size, viscosity, and dimension, all of which may be selected based on any of a wide variety of design considerations. The amount of energy applied by one or more of the energy sources may also depend on design considerations, such as, but not limited to, the desired width of the ink droplet, the type of substrate being used, and the desired properties and/or uses of the finished product.

Figure 4A:
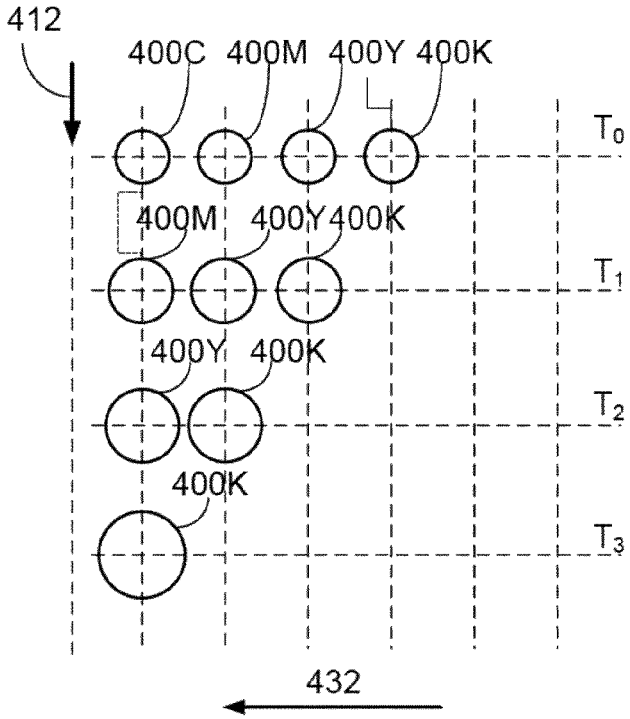
FIGS. 4*a-b* are schematic diagrams illustrating positive dot gain for a four color print head assembly.
Figure 4B:
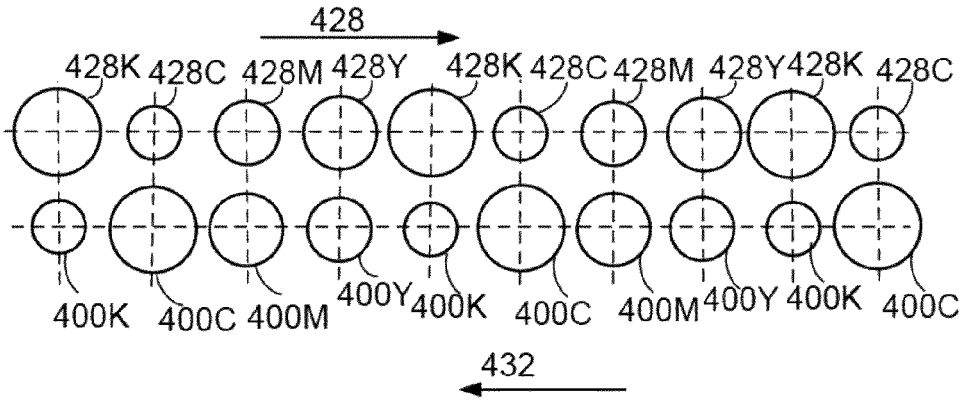

FIGS. 4*a*-*b* are schematic diagrams illustrating positive dot gain for a four color print head assembly. In FIG. 4*a*, one or more inkjet print heads substantially simultaneously eject ink droplets (e.g., for cyan (C), magenta (M), yellow (Y), and black (K)) on the substrate. At time T0, the active energy source, moving in the direction illustrated by arrow 412, causes the ink droplets illustrated by 400C, 400M, 400Y, and 400K to begin cure. Ink spot 4000 is cured first. Then at time T1, the deposited ink cures to form ink spots 400M, 400Y at T2, and 400K at T3.

Although all of the ink droplets are deposited with the same ink volume, the cyan ink forms the smallest spot 400C on the substrate (because it is cured first), and the black ink forms the largest spot 400K (because it is cured last). A similar ink spot behavior is exhibited when the carriage moves in the opposite direction, but the cyan spot 428C then has the largest size, as can be seen in FIG. 4*b*.

Two swaths are shown printed in FIG. 4*b*. One swatch was printed when the print head moved in the direction illustrated by arrow 428, and the second swatch was printed when the print head moved in the direction of arrow 432. It is readily apparent that the difference in the ink spot size created by positive dot gain results in visible artifacts unless ink deposition is controlled during printing.

Accordingly, it can be seen that the size of the ink spots depends on, among other things, the location of the print head relative to the energy source, and/or the movement or print head displacement direction. The variations of spot size complicate faithful color reproduction, creating undesired visual effects (e.g., undesired "strips" or color bands). To reduce these visual effects, multiple printing passes may be tried, but this slows production and reduces the overall printer throughput.

Figure 5:
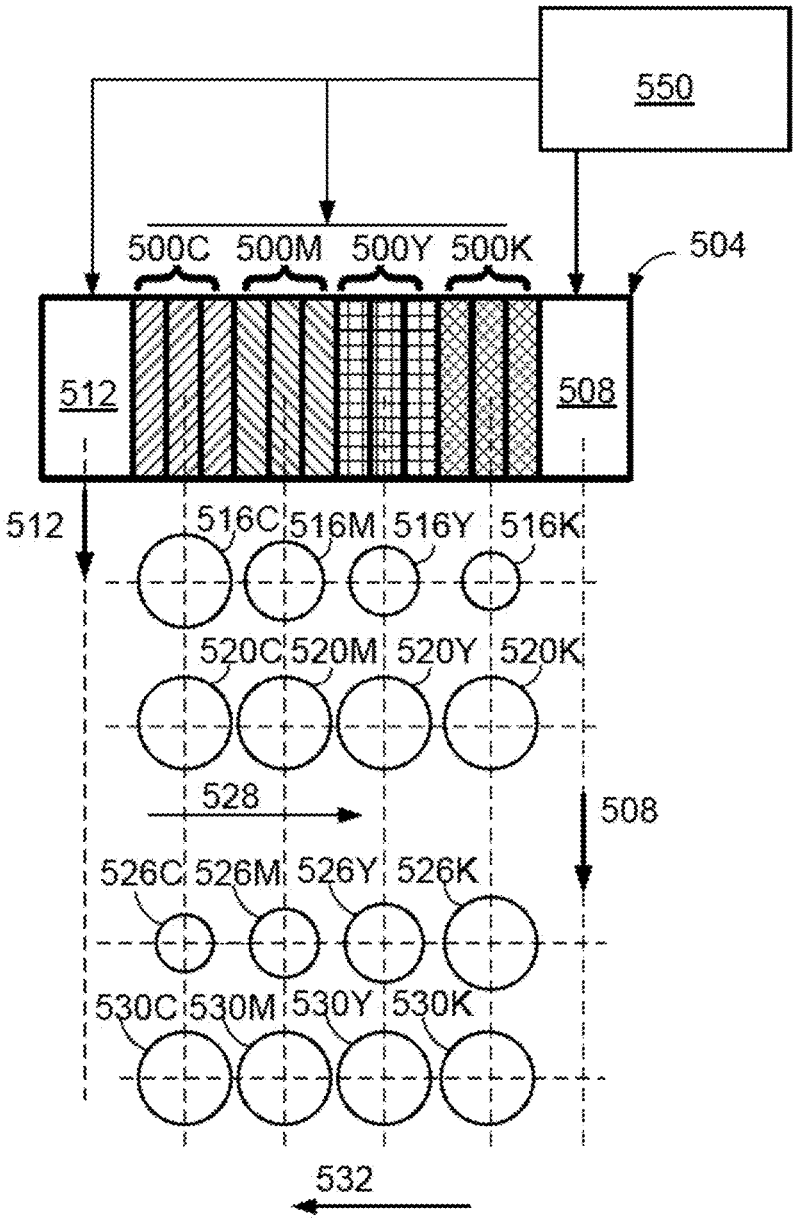
FIG. 5 is a schematic illustration of ink deposition compensated for positive dot gain.

FIG. 5 is a schematic illustration of ink deposition compensated for positive dot gain. Carriage 504 carries a number of drop-on-demand inkjet print heads that include one or more black print heads 500K, one or more yellow print heads 500Y, one or more of magenta print heads 500M, and one or more of cyan print heads 500C. Energy sources 508 and 512 (e.g., UV radiation) are attached to and positioned on either side of a carriage 504, such that all print heads 500 are between the energy sources. The substrate may be static or move in a desired direction. Carriage 504 is located opposite the substrate at a distance enabling ink droplets towards the substrate ejection. The carriage reciprocates relative to substrate in a direction shown by arrows 528 and 532. Controller 540 controls operation of the printer.

In order to compensate for differences in the spot size formed by ink droplets of equal volume, controller 550 provides a different drive voltage to each of the print heads 500. For example, when carriage 504 with print heads 500 and energy sources 508 and 512 is displaced in a first direction indicated by arrow 528 and energy source 512 cures the printed ink spots, controller 550 adjusts the drive voltage of print heads 500 such that print heads located closer to the energy source 512 eject droplets 516C of a size larger than droplets 516M, 516Y, and 516K.

Controller 550 provides a different drive voltage to each of the print heads 500 when the carriage 504 moves in a second or opposite direction (shown by arrow 532) and energy source 508 is activated. In this case, droplet 526K ejected by black print head 500K has the largest volume and droplet 526C ejected by Cyan print head 500C has the smallest volume. The difference in the volume of the droplets is proportional to the distance of the print head from the radiation source to cure ink. Despite the difference in the volume of ejected droplets 526 they form spots 530 of equal size.

Table 1 (below) shows example drive voltage values for a print head having four of each color print heads (cyan, magenta, yellow, and black). The table shows how drive voltage changes as a function of print head module versus location from the energy source and displacement direction. For example, the voltage values (V1) may be applied to the respective print heads when moving in the direction illustrated by arrow 232 in FIG. 2, and the voltage values (V2) may be applied to the respective print heads when moving in the direction illustrated by arrow 228 in FIG. 2. It is noted that the values shown in Table 1 are for a pH values of 1 to 16. These values may be adjusted based on different pH values and other parameters.

TABLE 1

| | 16 | 15 | 14 | 13 | 12 | 11 | 10 | 9 | 8 | 7 | 6 | 5 | 4 | 3 | 2 | 1 |
|---|---|---|---|---|---|---|---|---|---|---|---|---|---|---|---|---|
| V1 | 110 | 110 | 110 | 110 | 110 | 110 | 113 | 116 | 119 | 122 | 125 | 128 | 131 | 134 | 137 | 140 |
| V2 | 140 | 137 | 134 | 131 | 128 | 125 | 122 | 119 | 116 | 113 | 110 | 110 | 110 | 110 | 110 | 110 |

Figure 6:
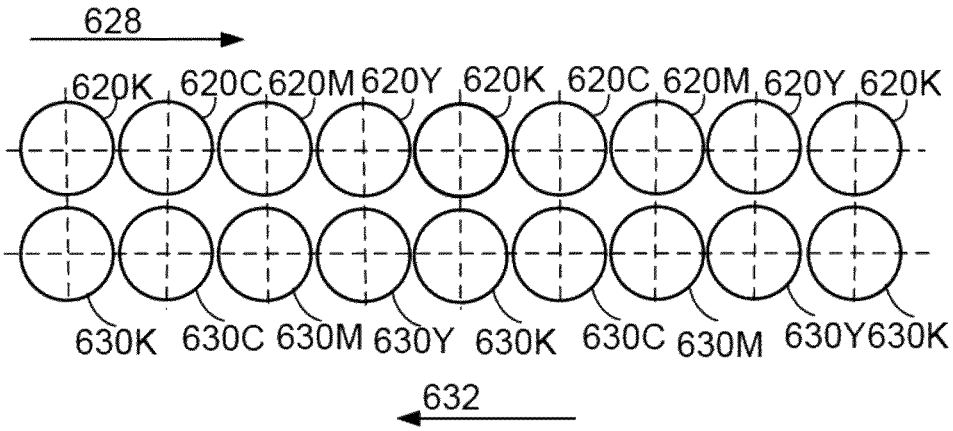
FIG. 6 is a schematic illustration of a portion of a printed image which has been compensated for positive dot gain.

FIG. 6 is a schematic illustration of a portion of a printed image which has been compensated for positive dot gain. It can be readily seen that printed spots 620 and 630 for each color printed by the print head moving in different/opposite directions (as illustrated by arrows 628 and 632) have the same size when cured and therefore do not form visible image artifacts.

It is noted that that the techniques described herein may also be applied to print heads operating in multi drop mode. For multi drop print heads adaptation of the drop volume or spot size may be performed by ejecting different number of droplets as function of print head versus energy source location and displacement direction.

Figure 7:
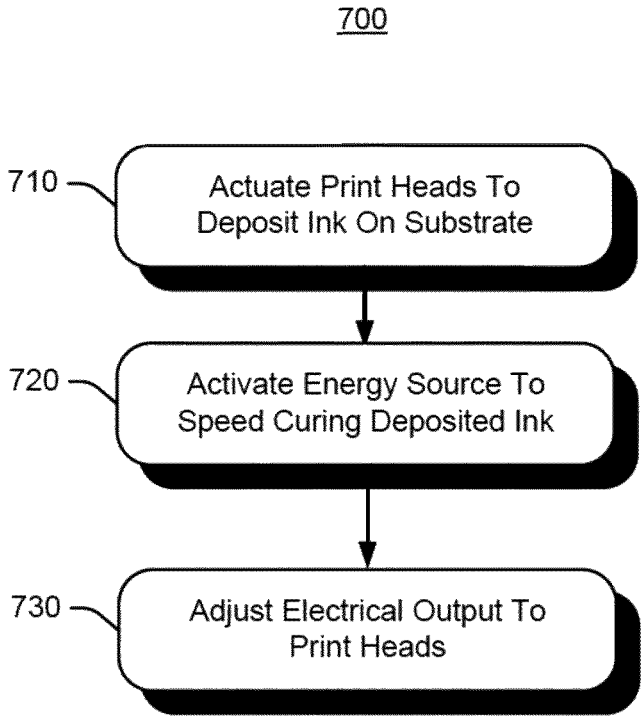
FIG. 7 is a flowchart illustrating exemplary operations which may be implemented for controlling ink deposition during printing.

FIG. 7 is a flowchart illustrating exemplary operations which may be implemented for controlling ink deposition during printing. Operations 700 may be embodied as logic instructions on one or more computer-readable medium. When executed on a processor, the logic instructions cause a general purpose computing device to be programmed as a special-purpose machine that implements the described operations. The program code may be implemented as firmware, software, and/or in hardware. In an exemplary implementation, the components and connections depicted in the figures may be used.

In operation 710, a plurality of print heads are actuated to deposit ink on a substrate. In operation 720, an energy source is activated to speed cure of the deposited ink on the substrate. In operation 730, electrical output to the plurality of print heads is adjusted to compensate for different distances from the energy source to each of the plurality of print heads.

The operations shown and described herein are provided to illustrate exemplary implementations of controlling ink deposition during printing. It is noted that the operations are not limited to the ordering shown. Still other operations may also be implemented.

Operations may also include changing the electrical output to the plurality of print heads based on direction the plurality of print heads is moving. Operations may also include maintaining substantially uniform size of ink deposited on a substrate. Operations may also include maintaining substantially uniform color appearance of ink deposited on a substrate. Operations may also include reducing dot gain of ink deposited on a substrate. Operations may also include reducing a number of passes of the plurality of print heads during ink deposition on a substrate. For example, reducing volume of ink deposited by print heads located a lesser distance from the energy source, and increasing volume of ink deposited by print heads located a greater distance from the at least one energy source, results in different volumes of ink from the plurality of print heads forming ink droplets on the substrate having substantially the same cured size as one another.

It is noted that the exemplary embodiments shown and described are provided for purposes of illustration and are not intended to be limiting. Still other embodiments are also contemplated for controlling ink deposition during printing.

The invention claimed is:

1. A method comprising:

actuating a plurality of print heads to deposit printer fluid on a substrate;

activating an energy source to speed cure of the deposited printer fluid on the substrate;

adjusting electrical output to the plurality of print heads to compensate for different distances from the energy source to each of the plurality of print heads; and changing the electrical output to the plurality of print heads based on a direction the plurality of print heads is moving.

2. The method of claim 1, further comprising maintaining substantially uniform size of printer fluid deposited on a substrate.

3. The method of claim 1, further comprising maintaining substantially uniform color appearance of printer fluid deposited on a substrate.

4. The method of claim 1, further comprising reducing dot gain of printer fluid deposited on a substrate.

5. The method of claim 1, further comprising reducing a number of passes of the plurality of print heads during printer fluid deposition on a substrate.

6. The method of claim 1, wherein the electrical output to the plurality of print heads corresponds to a volume of printer fluid to be deposited by the plurality of print heads.

7. The method of claim 1, wherein a volume of droplet ejected from the printhead is controlled based on a time between deposition of the droplet on the substrate and cure of the droplet by the energy source.

8. A controller for a printing system in which the controller is operatively associated with a plurality of printheads configured to deposit printer fluid on a substrate, the controller configured to:

output a first predetermined firing waveform to a first printhead when the first printhead is traveling in a first direction and output a second, different predetermined firing waveform to the first printhead when the first printhead is traversing in a second direction, wherein differences between the first and second predetermined firing waveforms depend on a separation between an energy source for curing ejected printer fluid and the print head and depend on the speed and direction of travel of the printhead.

9. The controller of claim 8, wherein the first printhead ejects a droplet of a first size when the printhead is traversing in the first direction and the printhead ejects a droplet of a second size when the printhead is traversing in the second direction.

10. The controller of claim 9, wherein, when cured, a diameter of a droplet of the first size and a diameter of a droplet of the second size are equivalent.

11. The controller of claim 9, wherein the droplets of the first size comprise a printing fluid with a large positive drop gain.

12. The controller of claim 11, wherein the printing fluid has a pH greater than 10.

13. The controller of claim 8, wherein each printhead ejects a droplet of a different size while traversing in the first direction, and diameters of the cured ejected droplets from each of the printheads are the same.

14. The controller of claim 13, wherein the printheads eject a plurality of different color printing fluids.

15. The controller of claim 8, wherein the first predetermined firing waveform produces an ejection of a first number of droplets and the second predetermined firing waveform produces an ejection of a different number of droplets.

* * * * *